US007383901B2

(12) United States Patent
Rayner

(10) Patent No.: US 7,383,901 B2
(45) Date of Patent: Jun. 10, 2008

(54) RELEASABLE AUGER TOOTH

(75) Inventor: Alister Gordon Rayner, Cheltenham (GB)

(73) Assignee: Auger Torque Europe Limited, Cheltenham (GB)

( * ) Notice: Subject to any disclaimer, the term of this patent is extended or adjusted under 35 U.S.C. 154(b) by 305 days.

(21) Appl. No.: 10/917,335

(22) Filed: Aug. 13, 2004

(65) Prior Publication Data

US 2005/0044755 A1 Mar. 3, 2005

(30) Foreign Application Priority Data

Aug. 13, 2003 (GB) ..... 0318995.8
May 5, 2004 (GB) ..... 0409966.9

(51) Int. Cl.
*E21B 10/44* (2006.01)
*E02F 9/28* (2006.01)

(52) U.S. Cl. ..... 175/413; 37/457

(58) Field of Classification Search ..... 175/413; 37/457

See application file for complete search history.

(56) References Cited

U.S. PATENT DOCUMENTS

| | | | | |
|---|---|---|---|---|
| 2,852,874 | A | 9/1958 | Grubb | |
| 2,968,880 | A | 1/1961 | Petersen | |
| 3,136,077 | A | 6/1964 | Troeppl | |
| 3,286,378 | A | 11/1966 | Benetti | |
| 3,305,954 | A * | 2/1967 | Troeppl et al. | 37/457 |
| 3,316,988 | A | 5/1967 | Petersen | |
| 3,323,235 | A * | 6/1967 | Petersen | 37/457 |
| 3,323,236 | A | 6/1967 | Petersen | |
| 3,359,662 | A * | 12/1967 | Petersen | 37/457 |
| 4,170,267 | A | 10/1979 | Bourlier | |
| 4,744,158 | A * | 5/1988 | Berchem et al. | 37/457 |
| 5,579,594 | A | 12/1996 | Pasqualini et al. | |

FOREIGN PATENT DOCUMENTS

GB 2 105 388 3/1983

* cited by examiner

*Primary Examiner*—Giovanna C Wright
(74) *Attorney, Agent, or Firm*—Young & Thompson

(57) ABSTRACT

A releasable auger tooth for an auger includes a slot shaped to fit a U-shaped or substantially U-shaped recess of a tooth holder element, and a tooth channel shaped to receive at least part of a shock-absorbing element and/or a wedging element. A holder element and assemblies are also provided.

7 Claims, 6 Drawing Sheets

10

RELEASABLE AUGER TOOTH

BACKGROUND OF THE INVENTION

This invention relates to a releasable auger tooth, holder element and assembly.

It is preferable that the teeth used on an auger (shown in FIG. 1) are removable and replaceable. This allows for replacement of one or more of the teeth due to wear and damage without having to replace the entire shank plate. However, teeth rapidly become damaged when, for example, striking stone or other hard material, and this is especially so when the incorrect tooth is fitted. A case in point is the striking of rock or concrete when using a relatively soft earth-digging tooth.

In any new arrangement, backwards compatibility with existing tools and machinery is always a preferred option.

The present invention therefore seeks to provide a solution to the rapid wear and damage of auger teeth, while enabling backwards compatibility.

SUMMARY OF THE INVENTION

According to a first aspect of the invention, there is provided a releasable auger tooth comprising a slot shaped to fit a U-shaped or substantially U-shaped recess of a tooth holder element, and a tooth channel shaped to receive at least part of one of a shock-absorbing element, a wedging element and a shock-absorbing/wedging element.

According to a second aspect of the invention, there is provided an auger tooth holder element comprising a U-shaped or substantially U-shaped holder element recess in which an auger tooth is receivable, and a holder element channel shaped to receive at least part of a shock-absorbing element.

According to a third aspect of the invention, there is provided an auger tooth assembly comprising a releasable auger tooth, a holder element, and a shock-absorbing element which, when the said tooth is received in the recess of the said holder element, at least in part prevents shock imparted to the said tooth from being transmitted to the said holder element.

According to a fourth aspect of the invention, there is provided an auger tooth assembly comprising a releasable auger tooth; an auger tooth holder element comprising a U-shaped or substantially U-shaped holder element recess in which the said tooth is receivable, and a through-hole which breaks out at two spaced locations in the said recess; and a flexible elongate wedging element locatable in the said through-hole, the said wedging element preventing or limiting unintentional separation of the said tooth and the said holder element when the said tooth is received in the said recess of the said holder element.

According to a fifth aspect of the invention, there is provided an excavating auger comprising a shank plate and a plurality of auger tooth assemblies in accordance with the third aspect of the invention.

According to a sixth aspect of the invention, there is provided an excavating auger comprising a shank plate and a plurality of auger tooth assemblies in accordance with the fourth aspect of the invention.

The invention will now be more particularly described, by way of example, with reference to the accompanying drawings.

DESCRIPTION OF THE PREFERRED EMBODIMENTS

Referring firstly to FIGS. 2 to 8 of the drawings, there is shown, in part, a first embodiment of an auger tooth assembly 10 which comprises a holder element 12, a tooth 14, a shock-absorbing element 16, and means for releasably engaging the holder element 12 and the tooth 14.

Figure 1:
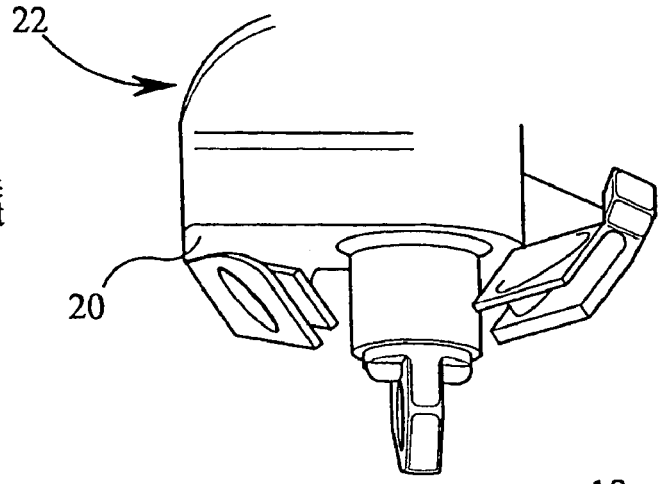
FIG 1 Prior art
FIG. 1 shows a side view of the end of a known auger with shank plate and prior art holder elements, the teeth having been removed.
Figure 2:
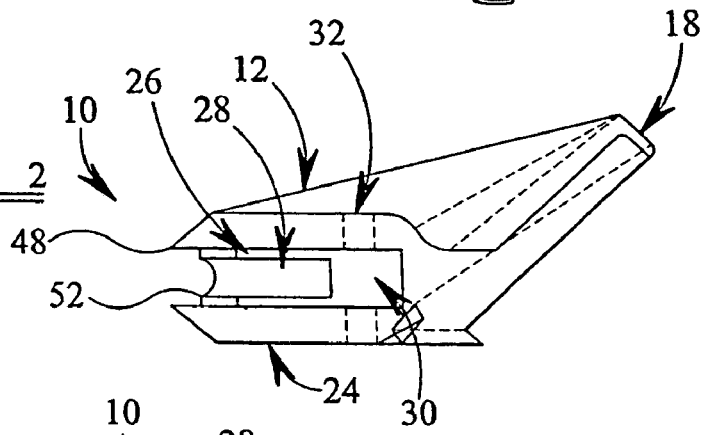
FIG. 2 is a side elevational view of a holder element of a first embodiment of an auger tooth assembly and which is in accordance with the second aspect of the invention.
Figure 3:
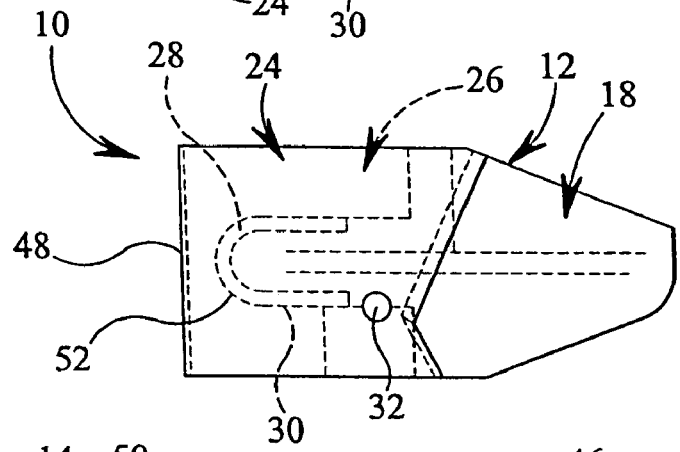
FIG. 3 is a plan view of the holder element shown in FIG. 2.
Figure 4:
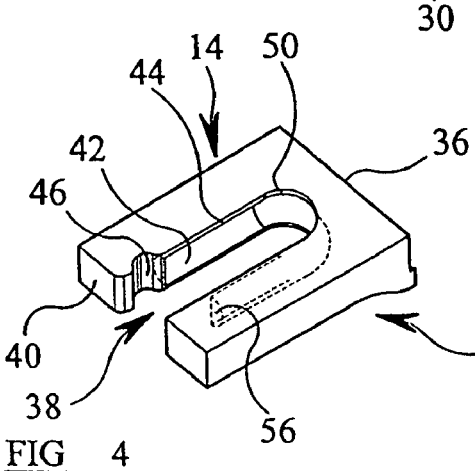
FIG. 4 is a perspective view of an auger tooth of the first embodiment of the auger tooth assembly and which is in accordance with the first aspect of the invention.
Figure 5:
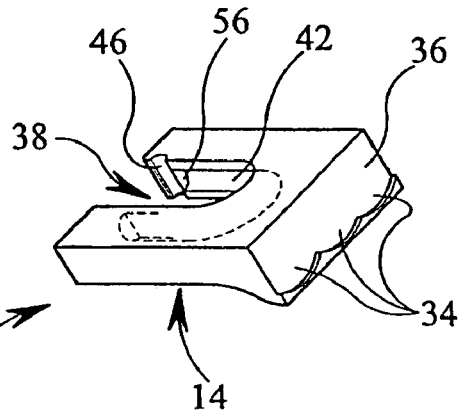
FIG. 5 is another perspective view of the tooth shown in FIG. 4.
Figure 6:
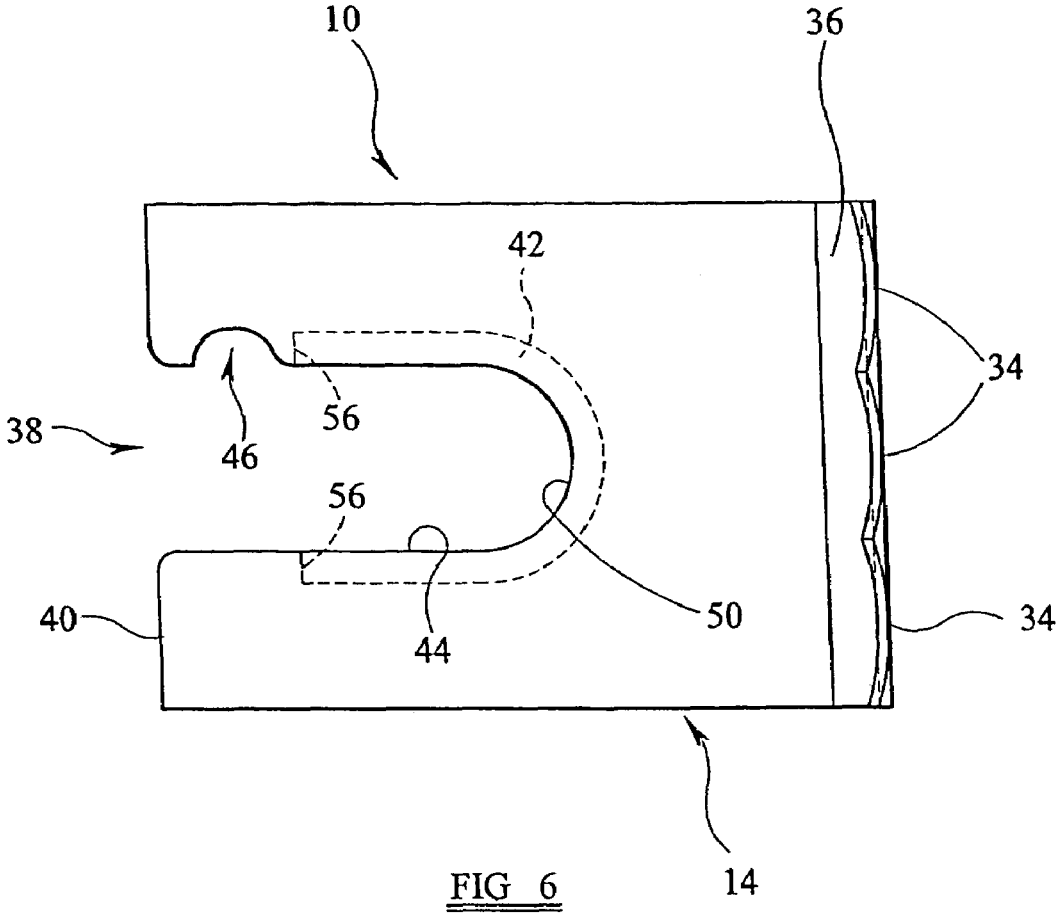
FIG. 6 is a plan view of the tooth shown in FIG. 4.
Figure 7:
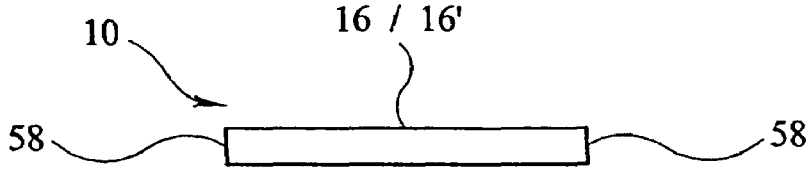
FIG. 7 is a side view of a shock-absorbing element of the first embodiment of the auger tooth assembly, and which is also a wedging element of a second embodiment of an auger tooth assembly and a shock-absorbing/wedging element of a third embodiment of an auger tooth assembly.

The holder element 12 is typically formed from cast alloy steel and includes a first portion 18 for welding to a shank plate 20 of an excavating auger 22 (see FIG. 1, which shows an example of a typical auger) and a second portion 24 which receives the tooth 14. The second portion 24 has a U-shaped, or substantially U-shaped, recess 26 formed generally in the plane of the longitudinal extent of the holder element 12, and a U-shaped, or substantially U-shaped, channel 28 is formed in the bottom wall 30 of the recess 26. The longitudinal extent of the channel 28 extends in parallel, or substantially in parallel, to the longitudinal extent of the recess 26.

The second portion 24 of the holder element 12 also includes an aperture 32 which forms part of the releasable engaging means and which passes entirely through the second portion 24 at right angles, or transversely, to the longitudinal extent of the recess 26. The aperture 32 partially breaks out into the recess 26, and is dimensioned to receive a known type of pin element. The pin element (not shown) forms another part of the releasable engaging means.

The tooth 14 is also typically formed from cast alloy steel and, depending on requirements, may include tungsten carbide claws 34 formed on the leading edge 36.

A slot 38 is formed in the trailing edge 40 of the tooth 14. The slot 38 defines two leg portions 39. The slot 38 and the leg portions 39 allow the tooth 14 to be complementarily fittable in the U-shaped recess 26 of the holder element 12.

A channel 42, similar to the channel 28 of the holder element 12, is formed in the wall 44 defining the slot 38 of the tooth 14. The longitudinal extent of the tooth channel 42 extends in parallel, or substantially in parallel, with the plane in which the slot 38 lies. The tooth channel 42 is also formed in the wall 44 of the slot 38 at a position which corresponds to the position of the holder element channel 28 so that, when the tooth 14 is received in the recess 26 of the holder element 12, the tooth channel 42 and the holder element channel 28 align or substantially align. The channel 42 is closed at both ends.

The tooth 14 also includes a slightly elongate opening 46, in the form of a recess which opens out on to the upper and lower major surfaces of the tooth 14. The opening 46 is formed in the wall 44 of the slot 38 and is spaced from the channel 42. The opening 46 forms the final part of the releasable engaging means and, when the tooth 14 is held by the holder element 12, the opening 46 aligns with the aperture 32 in the second portion 24 of the holder element 12. The provision of only one holder element aperture 32 and tooth opening 46 prevents the tooth 14 from being incorrectly engaged with the holder element 12, for example by being engaged upside-down.

The shock-absorbing element 16 is a flexible elongate, typically rubber, strip which is locatable equally, or substantially equally, in both the tooth channel 42 and the holder element channel 28, so as to be interposed between the tooth 14 and the holder element 12. The shock-absorbing element is cylindrical, or substantially cylindrical, and has a typical diameter of 6 millimeters (mm), but may be of any suitable diameter, and of any suitable grade of rubber.

Providing the holder element 12 is initially empty, the shock-absorbing element 16 is first inserted into the channel 42 of the new tooth 14. The depth of the channel 42 is less than half the diameter of the shock-absorbing element 16, so that part of the transverse extent of the shock-absorbing element 16 projects therefrom.

Insertion of the shock-absorbing element 16 into the tooth channel 42 is far more convenient than trying to initially insert the shock-absorbing element 16 into the channel 28 in the recess 26 of the holder element 12, since the holder element 12 is generally fixed by welding to the shank plate 20 of the excavating auger 22.

The tooth 14 with shock-absorbing element 16 is then slotted into the recess 26 of the holder element 12 so that the projecting portion of the transverse extent of the shock-absorbing element 16 is, or is in part, received in the channel 28 of the holder element 12. As with the tooth channel 42, the depth of the holder element channel 28 is less than half the diameter of the shock-absorbing element 16. The blind-end of the slot 38 of the tooth 14 is thus, in a normal condition, spaced by the shock-absorbing element 16 from the tip 52 of the recess 26, which is adjacent the leading edge 48 of the holder element 12.

The pin element is then driven into the aperture 32 of the holder element 12 so that it passes through the slot opening 46 of the tooth 14. The tooth 14 is thus engaged with the holder element 12.

If the tooth 14 is to be replaced, the pin element is simply driven back out of the aperture 32, and the tooth 14 is removed.

With an auger in normal use and fitted with the tooth assembly 10, the tooth 14 compresses the shock-absorbing element 16 to varying degrees as the shank plate turns, thus damping vibration and absorbing general knocks and strikes. Limited movement of the tooth 14 in the holder element 12 is facilitated by the opening 46 in the tooth slot 38 being elongate, which thus allows relative movement of the pin element along the longitudinal extent of the opening 46 when the tooth 14 moves.

The blind-end 50 of the tooth slot 38 is, under normal conditions, spaced from the tip 52 of the recess 26 of the holder element 12.

If the tooth 14 strikes a particularly hard material, such as stone or rock, the generated energy from the impact is absorbed and dissipated by the tooth 14 increasingly compressing the shock-absorbing element 16. The limit of compression of the shock-absorbing element 16 is reached when the blind-end 50 of the tooth slot 38 contacts the tip 52 of the recess 26 of the holder element 12, or the end of the elongate opening 46 in the tooth slot 38 contacts the pin element.

Figure 9:
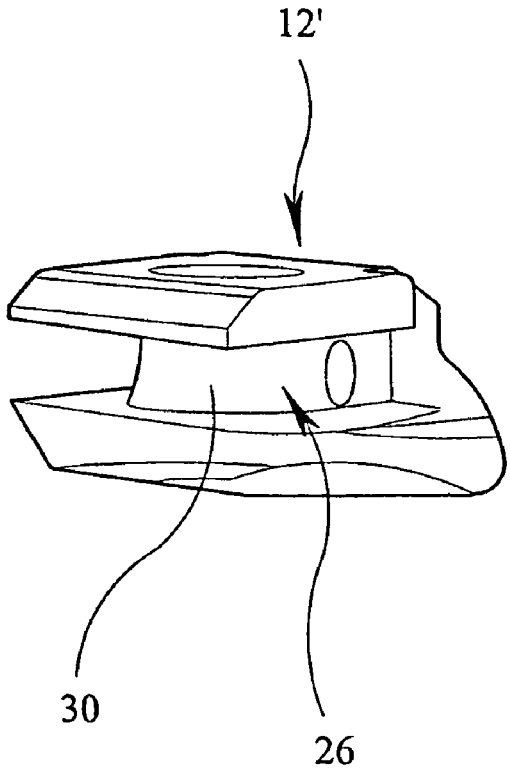
FIG 9 Prior art
FIG. 9 is a perspective view of a prior art holder element.
Figure 10:
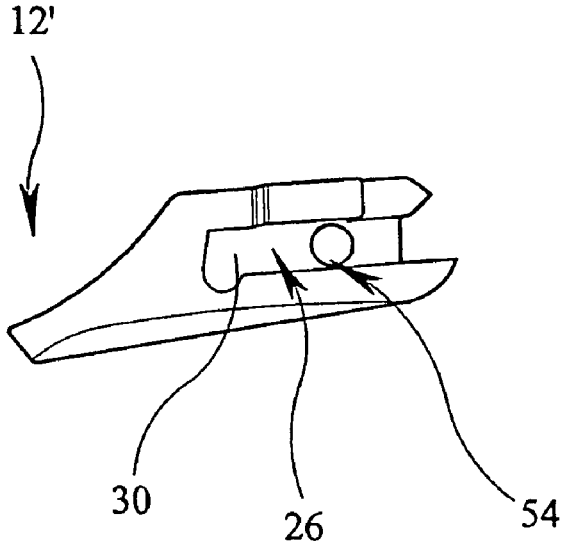
FIG 10 Prior art
FIG. 10 is a side elevational view of the holder element shown in FIG. 9.

The tooth 14 described above is also backwards compatible with earlier types of holder element 12'. As shown in FIGS. 9 and 10, the known prior art holder elements 12' forego the channel 28 of the first embodiment formed in the recess 26, but instead have a through-hole 54 formed in the bottom wall 30 of the holder element recess 26, transverse to the longitudinal extent of the holder element 12. A traditional auger tooth (not shown) has the slot 38 of the tooth 14 of the first embodiment, but is not formed with the tooth channel 42.

The through-hole 54 of the earlier holder element 12' is adapted to receive a known flexible wedging element 16' (see FIGS. 7 and 8), which is in the form of an elongate rubber strip. The wedging element 16' is similar in appearance to the shock-absorbing element 16 of the first embodiment, and projects from both ends of the through-hole 54 when inserted. A traditional auger tooth (not shown) is then simply urged onto the earlier holder element 12', causing the projecting ends of the wedging element 16' to be folded backwards and thus allowing the traditional tooth to be wedge fit on to the earlier holder element 12'.

When using the prior art holder element 12', the shock-absorbing element 16 of the first embodiment is therefore used instead as wedging element 16'.

The wedging element 16' is first inserted through the through-hole 54 of the prior art holder element 12', rather than placed in the channel 42 of the tooth 14. The tooth 14 of the first embodiment is then, in a similar fashion to the prior art method, urged onto the traditional holder element 12'. This causes the wedging element 16' to fold backwards. However, in this case, the ends of the wedging element 16' then tend to splay outwards into the channel 42 of the tooth 14 when the tooth 14 is fully pushed onto the prior art holder element 12'. The ends 56 (best seen in FIG. 6) of the tooth channel 42 act as shoulders against which the ends 58 of the wedging element 16' press to further prevent or inhibit separation of the tooth 14 from the prior art holder element 12' and decrease relative tooth movement. The pin element can be dispensed with. In this case, the wedging element 16' and the ends 56 of the channel 42 of the tooth 14 act in conjunction to form the releasable engaging means.

Figure 11:
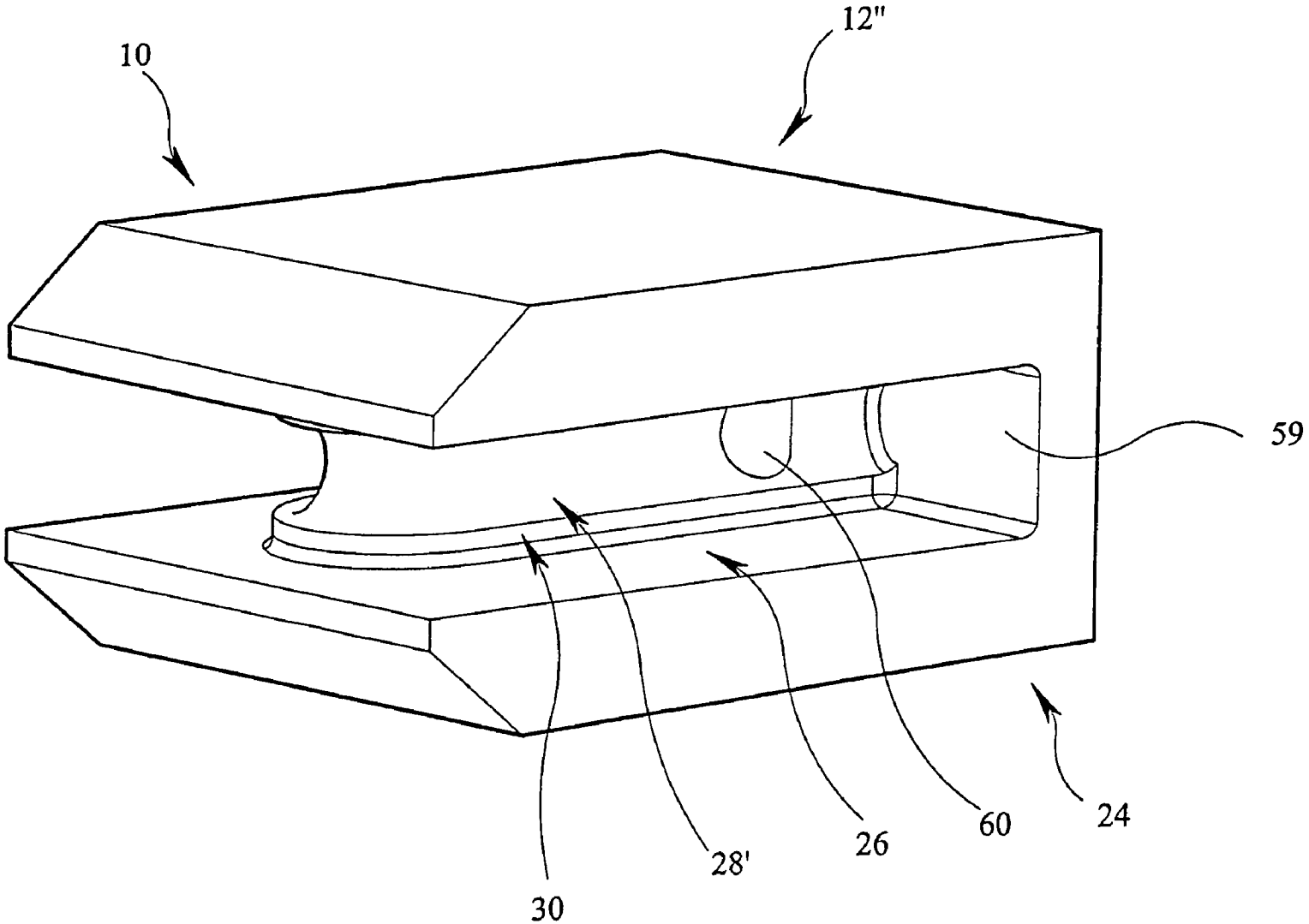
FIG. 11 is a perspective view of an auger tooth holder element of the third embodiment of the auger tooth assembly, in accordance with the second aspect of the invention.
Figure 12:
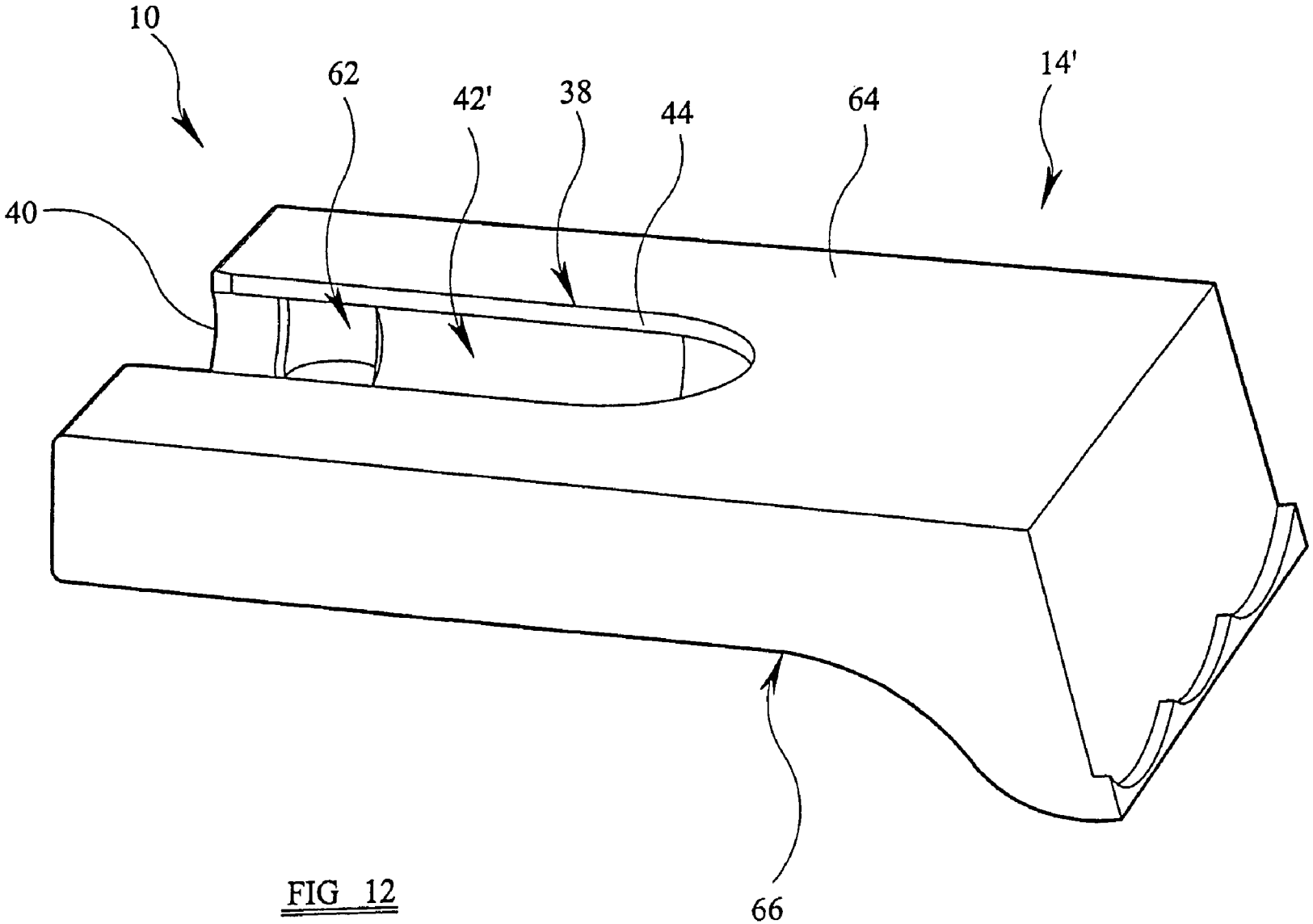
FIG. 12 is a perspective view of a releasable auger tooth of the third embodiment of the auger tooth assembly and which is in accordance with the first aspect of the invention.

With reference to FIGS. 11 and 12, a third embodiment of an auger tooth assembly will now be described. The parts similar to the parts of the first and second embodiments bear similar references, and further description is omitted.

Figure 8:
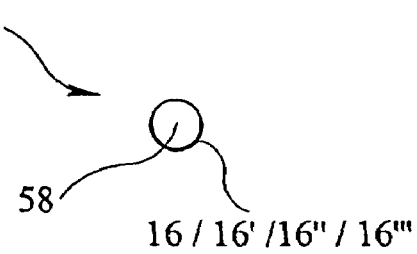
FIG. 8 is an end view of the shock-absorbing/wedging element shown in FIG. 7.

In this embodiment, the shock-absorbing element 16 or wedging element 16', shown in FIG. 8, is employed not only to provide a shock-absorbing function, but also as part of the means for releasably engaging a tooth 14' with a holder element 12". It is thus referred to as a shock-absorbing/wedging element and is referenced as 16".

The holder element 12" is formed similarly to that of the holder element 12 of the first embodiment. As such, the holder element 12" also has the first portion (not shown) for welding to the shank plate 20 of an auger 22, and second portion 24 which receives the tooth 14'. The second portion 24 again has the U-shaped, or substantially U-shaped, recess 26 formed generally in the plane of the longitudinal extent of the holder element 12", and a U-shaped, or substantially U-shaped, channel 28' formed in the bottom wall 30 of the recess 26.

In this embodiment, the channel 28' extends to end wall 59 of the recess 26 of the holder element 12", and includes a single occlusion 60 formed adjacent to, but spaced from, the end wall 59. The occlusion 60 does not project out of the channel 28', and forms part of the releasable engaging means. The aperture 32 of the holder element 12 and pin element are dispensed with.

The tooth 14' includes a channel 42' formed in the slot 38. The channel 42' extends around the wall 44 defining the slot 38, and breaks out on the trailing edge 40 of the tooth 14'.

The channel 42' includes an occlusion recess 62 adjacent to, but spaced from, the trailing edge 40 of the tooth 14'. The occlusion recess 62 of the tooth 14' and the occlusion 60 of the holder element 12" are complementarily dimensioned. The occlusion recess 62 is positioned along the channel 42' so that it will align, or substantially align, with the occlusion 60 when the holder element 12" and the tooth 14' are mated.

The occlusion recess 62 does not break out on to upper and lower major surfaces 64 and 66 of the tooth 14'. The occlusion recess 62 forms the final part of the releasable engaging means.

The elongate opening 46 of the tooth 14 of the first embodiment, which is intended to accept the pin element, is dispensed with.

It is intended, in this embodiment, that the shock-absorbing/wedging element 16" is pre-moulded or pre-located in the channel 42' of the tooth 14' prior to the tooth 14' being supplied to the user. It is of course possible for a user to manually locate the shock-absorbing/wedging element 16" in the channel 42' of the tooth 14'.

In any event, when the tooth 14' is separate from the holder element 12", the shock-absorbing/wedging element 16", when provided or located in the channel 42', simply bridges or spans the occlusion recess 62 rather than entering the occlusion recess 62.

In use, and with the shock-absorbing/wedging element 16" residing in the channel 42', the tooth 14' is urged into engagement with the holder element 12", as described previously. As the tooth 14' is pushed home, the occlusion 60 in the channel 28' of the holder element 12" urges part of the shock-absorbing/wedging element 16" into the adjacent occlusion recess 62 of the tooth 14'. The tooth 14' is thereby effectively locked to the holder element 12", preventing or limiting unintentional separation.

The tooth 14' is removed from the holder element 12" in any suitable known way, for example by knocking with a hammer and chisel.

Although only one occlusion and corresponding occlusion recess are required, more than one occlusion and corresponding occlusion recess could be provided. The provision of only one occlusion and occlusion recess aids in preventing the tooth 14' from being incorrectly engaged with the holder element 12", for example by being engaged upside-down.

Figure 13:
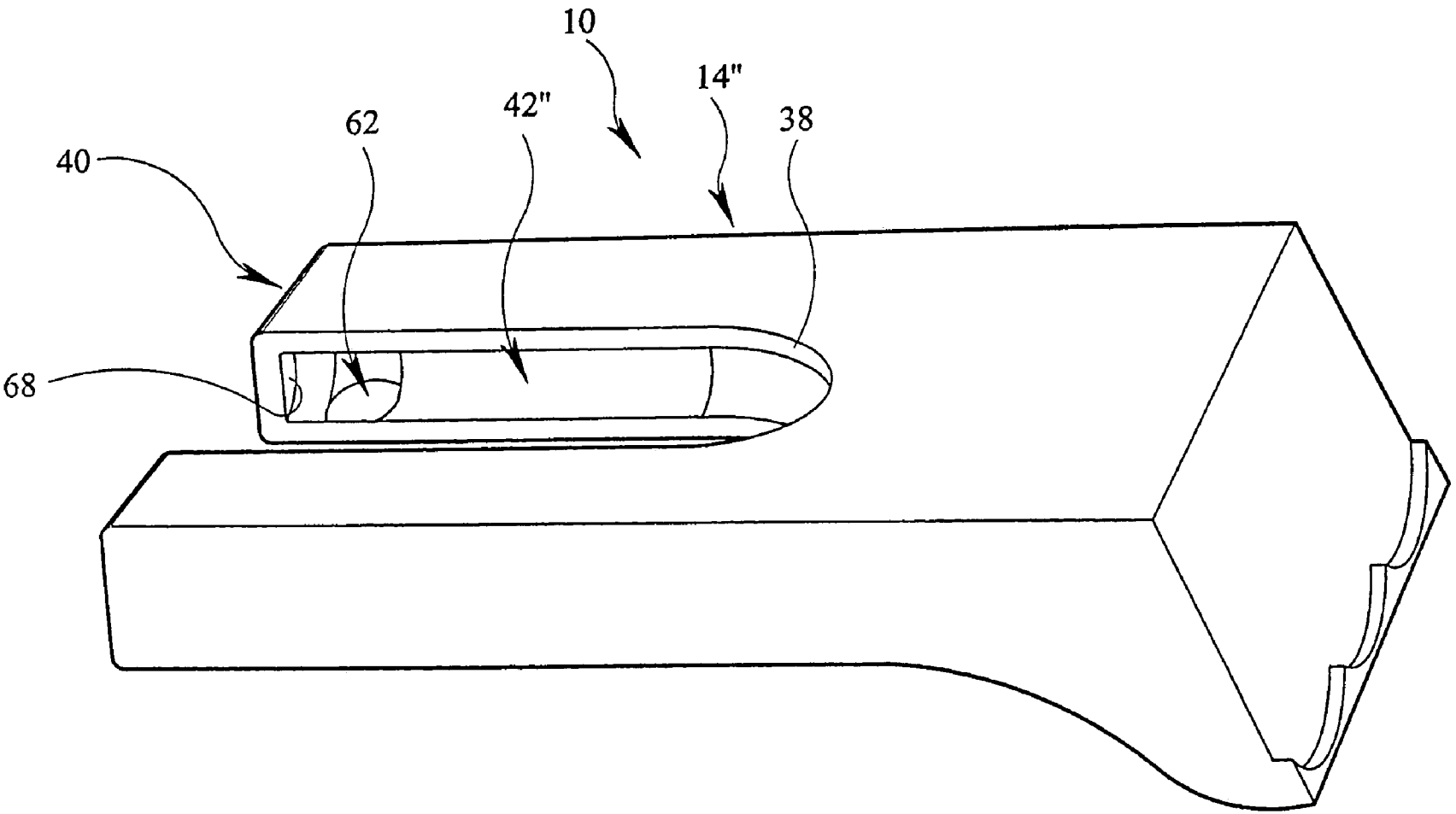
FIG. 13 is a perspective view of a further embodiment of an auger tooth, in accordance with the first aspect of the invention.

Referring to FIG. 13, a further embodiment of an auger tooth is shown. This tooth 14" differs from the tooth 14' described above in that the channel 42" no longer breaks out on to the trailing edge 40 of the tooth 14". Parts which correspond to the parts of the earlier embodiments therefore share the same references, and further details are omitted.

The channel 42" is therefore a closed channel, rather than the open channel of the previous embodiment. The occlusion recess 62, although not seen, is still provided.

By having the closed channel 42", shock-absorbing/wedging element 16'", if not affixed to the tooth 14", is prevented from separating from the tooth 14" when the tooth 14" is removed from the holder element 12". As the tooth 14" is withdrawn from the recess 26 of the holder element 12", the ends 58 of the shock-absorbing/wedging element 16'" contact the end faces 68 of the closed channel 42". Further movement of the shock-absorbing/wedging element 16'" along the longitudinal extent of the channel 42" is thus prevented, and the tooth 14" can be separated from the holder element 12" with the shock-absorbing/wedging element 16'" intact.

This is particularly advantageous when multiple holder elements 12" are mounted to a shank plate in close proximity to each other, which is often the case. If the shock-absorbing/wedging element 16'" remains on the holder element 12", it can be particularly troublesome and difficult to try and then remove the element 16'" independently.

The reverse situation also holds true, and it is of particular advantage to have the shock-absorbing element 16 and shock-absorbing/wedging element 16"/16'" initially residing on the tooth 14/14'/14", rather than having to attempt mounting the element 16/16"/16'" initially on the holder element 12/12".

The teeth 14'/14" can also be used with existing holder elements, in a similar manner to that described above.

The shock-absorbing element or shock-absorbing/wedging element could be interposed between the trailing edge of the tooth and the end wall of the recess of the holder element.

The shock-absorbing element and/or shock-absorbing/wedging element, although preferably rubber, could be of any suitable shock-absorbing material. The shock-absorbing element and/or shock-absorbing/wedging element could also have a non-circular transverse cross-section, if necessary.

It is thus possible to provide an auger tooth assembly which reduces the wear and damage caused to a tooth when in use. It is also possible to provide a tooth which is backwards compatible with an existing holder element of a tooth assembly.

The embodiments described above are given by way of example only, and other modifications will be apparent to persons skilled in the art without departing from the scope of the invention as defined by the appended claims.

What is claimed is:

1. An auger tooth assembly comprising a releasable auger tooth, a holder element, and a shock-absorbing element in contact with and detachably interposable between the tooth and the holder element in at least a direction perpendicular to a leading edge of the tooth and which, when the said tooth is received in a recess of the said holder element, at least in part prevents shock imparted to the said tooth from being transmitted to the said holder element, wherein the shock-absorbing element is detachably mountable on a rear-facing wall of the tooth to space a trailing end of the tooth in the recess of the holder element from an adjacent wall of the recess of the holder element, further comprising a pin element which, when the said tooth is received in the said recess of the said holder element, prevents or limits unintentional separation of the said tooth and the said holder element.

2. An auger tooth assembly as claimed in claim 1, wherein the said shock-absorbing element also acts as a wedging element to prevent or limit unintentional separation of the said tooth and the said holder element.

3. An auger tooth assembly as claimed in claim 1, wherein the said shock-absorbing element is a flexible elongate element.

4. An auger tooth assembly as claimed in claim 1, wherein the auger tooth is a releasable auger tooth comprising a slot shaped to fit a U-shaped or substantially U-shaped recess of a tooth holder element, and a tooth channel shaped to receive at least part of one of a shock-absorbing element, a wedging element and a shock-absorbing/wedging element, and the holder element is an auger tooth holder element comprising a U-shaped or substantially U-shaped holder element recess in which an auger tooth is receivable, and a holder element channel shaped to receive at least part of a shock-absorbing element.

5. An excavating auger comprising a shank plate and a plurality of auger tooth assemblies as claimed in claim 1.

6. An auger tooth assembly comprising a releasable auger tooth, a holder element, and a shock-absorbing element in contact with and detachably interposable between the tooth and the holder element in at least a direction perpendicular to a leading edge of the tooth and which, when the said tooth is received in a recess of the said holder element, at least in part prevents shock imparted to the said tooth from being transmitted to the said holder element, wherein the tooth includes a slot shaped to fit the recess of the tooth holder element, and a rear-facing tooth channel in a rear-facing wall of the tooth and which is shaped to receive at least part of the shock-absorbing element, and wherein the shock-absorbing element is detachably mountable in the rear-facing tooth channel to space a trailing end of the tooth in the recess of the holder element from an adjacent, wall of the recess of the holder element.

7. An auger tooth assembly comprising a holder element, a tooth, a shock-absorbing element, and means for releasably engaging the holder element and the tooth, the shock-absorbing element, when the tooth is held by the holder element, being in contact with and interposed between the tooth and the holder element in at least a direction perpendicular to a leading edge of the tooth, wherein the tooth includes a slot shaped to fit the recess of the tooth holder element, and a rear-facing tooth channel in a rear-facing wall of the tooth and which is shaped to receive at least part of the shock-absorbing element, and wherein the shock-absorbing element is detachably mountable in the rear-facing tooth channel to space a trailing end of the tooth in the recess of the holder element from an adjacent wall of the recess of the holder element.

* * * * *